US007057334B2

(12) United States Patent
Callahan, Jr. et al.

(10) Patent No.: US 7,057,334 B2
(45) Date of Patent: Jun. 6, 2006

(54) MOUNT FOR METAL HALIDE ARC DISCHARGE LAMP

(75) Inventors: Edward M. Callahan, Jr., Derry, NH (US); Ebon L. McCullough, New Ipswich, NH (US); Glen P. Williamson, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 142 days.

(21) Appl. No.: 10/847,053

(22) Filed: May 17, 2004

(65) Prior Publication Data

US 2005/0253495 A1 Nov. 17, 2005

(51) Int. Cl.
*H01J 5/48* (2006.01)
*H01J 5/50* (2006.01)

(52) U.S. Cl. ..... 313/318.02; 313/242; 313/238; 313/318.05

(58) Field of Classification Search ..... 313/25, 313/238, 239, 242, 318.02, 318.05
See application file for complete search history.

(56) References Cited

U.S. PATENT DOCUMENTS 5,136,204 A 8/1992 Muzeroll
5,252,885 A 10/1993 Muzeroll
6,153,968 A 11/2000 Dombrowski
6,249,077 B1 6/2001 Brown
6,291,933 B1 9/2001 Dombrowski
6,459,191 B1 10/2002 Dombrowski
6,575,415 B1 * 6/2003 Williamson ..... 248/205.1
6,717,338 B1 * 4/2004 Williamson et al. ..... 313/50

FOREIGN PATENT DOCUMENTS

EP 1 458 009 A2 9/2004
GB 2362257 A 11/2001

* cited by examiner

*Primary Examiner*—Mariceli Santiago
*Assistant Examiner*—Anthony Perry
(74) *Attorney, Agent, or Firm*—William E. Meyer

(57) ABSTRACT

A mount (10) for a metal halide arc discharge lamp has a flare (20) including a barrel portion and a frame (32) comprises a clip (40) attached to the barrel portion (30). First and second side rods (50, 60) spaced 180° apart have distal ends (70) and proximal ends (80), with the distal ends being attached to the clip. First and second spaced apart straps (90, 100) connect the side rods intermediate the proximal ends and distal ends. An arc tube (110) is fixed between the first and second straps. The proximal ends diverge outwardly and engage the inner surface of a dome (14) to position one end of the mount. The barrel portion includes two sealed lead-in wires (120, 130). The arc tube includes an electrode (140, 150) in each end (140*a*, 150*a*). No electrical connection is made to the frame whereby the frame is electrically isolated.

10 Claims, 1 Drawing Sheet

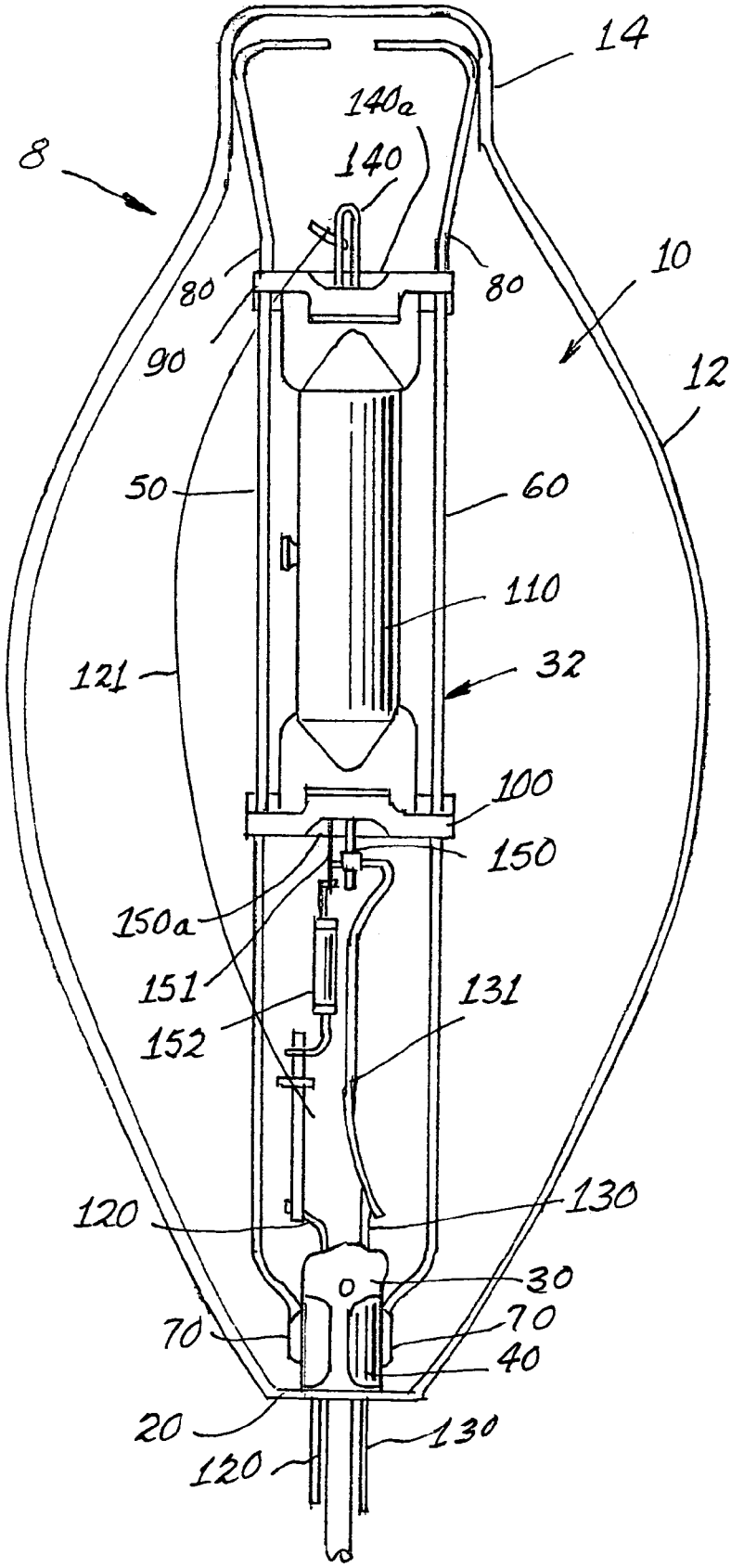
14
140a
140
8
80
80
10
90
12
50
60
110
121
32
100
150
150a
151
152
131
120
130
30
70
70
40
20
130
120

MOUNT FOR METAL HALIDE ARC DISCHARGE LAMP

TECHNICAL FIELD

This invention relates to metal halide arc discharge lamps and more particularly to mounts for such lamps.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including metal halide additives and a rare gas to facilitate starting. Mercury may also be included. In some cases, particularly in high wattage lamps, the outer envelope is filled with nitrogen or another inert gas at less than atmospheric pressure. In other cases, particularly in low wattage lamps, the outer envelope is evacuated.

To produce a practical lamp it is of course necessary to mount the arc tube within its outer envelope and the mounts formerly employed have a greater number of components and, therefore, more welds. Efforts to achieve automated mount assembly have not been reasonably successful and the failure of such efforts has added to the cost of the lamps. Also, in the past, lamps of different wattage had to have a specific mount structure, which also added to the cost.

It is also important that the mount does not cause or contribute to sodium migration from the arc tube, a frequent occurrence that deleteriously affects the light output of the lamp.

DISCLOSURE OF INVENTION

It is, therefore, an object of the invention to obviate the disadvantages of the prior art.

It is another object of the invention to enhance mount structures for arc discharge lamps.

Yet another object of the invention is the provision of an electrically isolated mount structure.

These objects are accomplished, in one aspect of the invention, by a mount for a metal halide arc discharge lamp that comprises a flare including a barrel portion. A frame comprising a clip is attached to the barrel portion and first and second side rods spaced 180° apart having distal ends and proximal ends are provided with their distal ends are attached to the clip. The rods have a given length. First and second spaced apart straps connect the first and second side rods intermediate the proximal and distal ends; and an arc tube is fixed between the first and second straps.

The mount has a reduced number of components and, therefore, a reduced number of welds. The arc tube straps are simple to install both automatically and manually, should the latter be necessary. The frame is electrically isolated to address sodium migration and the full frame design increases the strength of the mount.

BRIEF DESCRIPTION OF THE DRAWINGS

The single FIGURE is an elevational view, partially in section, of an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawings with greater particularity, there is shown in the FIGURE an arc discharge lamp 8 having a mount 10. An envelope 12 surrounds the mount and has a dome 14 at one end and a flare 20 sealing the opposite end. The flare 20 includes a barrel portion 30.

A frame 32 comprises a clip 40 that is attached to the barrel portion and first and second side rods 50, 60, respectively, that are spaced 180° apart and have their distal sends 70 attached to the clip. The clip 40 is C-shaped and preferably is held in place on the barrel portion 30 by a friction fit.

The rods 50 and 60 have a given length that extends virtually the entire length of the envelope 12 and have their proximal ends 80 diverging outwardly, that is, away from the longitudinal center of the envelope, forming a spring-like action to engage the inner surface of the dome 14.

First and second spaced apart straps, 90 and 100 respectively, connect the rods 50 and 60 intermediate the proximal and distal ends and fix and arc tube 110 between them.

The barrel portion 30 includes two lead-in wires 120, 130 sealed therein and the arc tube 110 includes electrodes 140 and 150, one sealed in respective ends 140*a* and 150*a*. In the embodiment shown an auxiliary electrode 151 is provided adjacent the electrode 150, as is known in the art. The lead-in wire 120 is electrically connected to the electrode 140 via the connector 121 and the lead-in wire 130 is electrically connected to the electrode 150 via connector 131. The auxiliary electrode 151 is connected to lead-in 120 via a resistor 152 as is known.

This construction allows the frame to be electrically isolated from the arc tube 110 and not form a part of the electrical connections, as was common in the prior art and thus greatly reduces any concerns about sodium migration that might be caused by the proximity of the rods 50 and 60 to the arc tube 110.

The frame is rugged and its construction is easily automated, thereby reducing the cost of the lamp and the number of resistance welds necessary is also reduced. The outwardly diverging proximal ends of the frame rods provide upper support of the entire mount assembly and reduce scratching of the outer envelope.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A mount for a metal halide are discharge lamp comprising:

a flare including a barrel portion;

a frame comprising a clip attached to said barrel portion and first and second side rods spaced 180° apart having distal ends and proximal ends, said distal ends being attached to said clip, said rods having a given length, said proximal ends diverging outwardly to frictionally engage a dome of a lamp enelope;

first and second spaced apart straps connecting said first and second side rods intermediate said proximal and distal ends; and an arc tube fixed between said first and second straps.

2. The mount of claim 1 wherein said barrel portion includes two lead-in wires.

3. The mount of claim 2 wherein said arc tube includes an electrode in each of its ends.

4. The mount of claim 3 wherein said frame is electrically isolated.

5. The mount of claim 4 wherein said electrical isolation is accomplished by having one of said lead-in wires electrically connected to one of said electrodes and another of said lead-in wires electrically connected to the other of said electrodes, whereby said frame provides only support for said arc tube.

6. A metal halide arc discharge lamp comprising:

a lamp envelope have a base end, a middle portion and a dome opposite said base end;

a flare including a barrel portion formed at said base end;

a frame comprising a clip attached to said barrel portion and first and second side rods spaced 180° apart having distal ends and proximal ends, said distal ends being attached to said clip, said rods having a given length, and diverging outwardly to frictionally engage said dome of said lamp enelope;

first and second spaced apart straps connecting said first and second side rods intermediate said proximal and distal ends; and an arc tube fixed between said first and second straps.

7. The metal halide aarc discharge lamp of claim 6 wherein said barrel portion includes two lead-in wires.

8. The mount of claim 7 wherein said arc tube includes an electrode in each of its ends.

9. The mount of claim 8 wherein said frame is electrically isolated.

10. The mount of claim 9 wherein said electrical isolation is accomplished by having one of said lead-in wires electrically connected to one of said electrodes and another of said lead-in wires electrically connected to the other of said electrodes, whereby said frame provides only support for said arc tube.

* * * * *